US011475855B2

(12) United States Patent
Liu

(10) Patent No.: US 11,475,855 B2
(45) Date of Patent: Oct. 18, 2022

(54) BACKLIGHT MODULE AND DISPLAY DEVICE

(71) Applicant: SHENZHEN CHINA STAR OPTOELECTRONICS SEMICONDUCTOR DISPLAY TECHNOLOGY CO., LTD., Guangdong (CN)

(72) Inventor: Xingyi Liu, Guangdong (CN)

(73) Assignee: SHENZHEN CHINA STAR OPTOELECTRONICS SEMICONDUCTOR DISPLAY TECHNOLOGY CO., LTD., Shenzhen (CN)

( * ) Notice: Subject to any disclaimer, the term of this patent is extended or adjusted under 35 U.S.C. 154(b) by 210 days.

(21) Appl. No.: 16/769,832

(22) PCT Filed: May 14, 2020

(86) PCT No.: PCT/CN2020/090335
§ 371 (c)(1),
(2) Date: Jun. 4, 2020

(87) PCT Pub. No.: WO2021/217731
PCT Pub. Date: Nov. 4, 2021

(65) Prior Publication Data

US 2022/0114974 A1 Apr. 14, 2022

(30) Foreign Application Priority Data

Apr. 28, 2020 (CN) ..... 202010349771.7

(51) Int. Cl.
*G09G 3/34* (2006.01)
*G09G 3/36* (2006.01)

(52) U.S. Cl.
CPC ..... *G09G 3/3426* (2013.01); *G09G 3/36* (2013.01); *G09G 2300/0842* (2013.01);
(Continued)

(58) Field of Classification Search
CPC ..... G09G 3/3426; G09G 3/36; G09G 2300/0842; G09G 2310/061; G09G 2310/08; G09G 2320/0233
See application file for complete search history.

(56) References Cited

U.S. PATENT DOCUMENTS 9,728,138 B2 * 8/2017 Kim ..... G09G 3/3233
2015/0170569 A1 * 6/2015 Han ..... G09G 3/3266 345/78

(Continued)

FOREIGN PATENT DOCUMENTS

CN 101079233 A 11/2007
CN 105761673 A 7/2016

(Continued)

*Primary Examiner* — Kenneth Bukowski

(57) ABSTRACT

A backlight module and a display device are provided. The backlight module includes a backlight source and a driving circuit for driving the backlight source. In the driving circuit corresponding to at least one backlight unit of the backlight source, a driving module is connected to a data signal input module and a compensation module through a first node, and is connected to the backlight unit through a second node. The compensation module is configured to pull down a potential of the first node to be less than a potential of the second node during a blank frame phase to make the threshold voltage of the driving module negatively biased.

10 Claims, 3 Drawing Sheets

(52) U.S. Cl.
CPC ... *G09G 2310/061* (2013.01); *G09G 2310/08* (2013.01); *G09G 2320/0233* (2013.01)

(56) References Cited

U.S. PATENT DOCUMENTS

| | | | | |
|---|---|---|---|---|
| 2016/0275871 | A1* | 9/2016 | Lee | G09G 3/2007 |
| 2018/0069999 | A1* | 3/2018 | Zhou | G09G 3/3426 |
| 2019/0180681 | A1* | 6/2019 | Wang | G09G 3/3291 |
| 2020/0051512 | A1* | 2/2020 | Li | G09G 3/3426 |
| 2020/0074929 | A1* | 3/2020 | Chen | G09G 3/3258 |
| 2021/0217362 | A1* | 7/2021 | Xu | G09G 3/3275 |

FOREIGN PATENT DOCUMENTS

| | | | |
|---|---|---|---|
| CN | 106023897 | A | 10/2016 |
| CN | 107871471 | A | 4/2018 |
| CN | 108717841 | A | 10/2018 |
| CN | 110070833 | A | 7/2019 |
| KR | 101577907 | B1 | 12/2015 |

* cited by examiner

BACKLIGHT MODULE AND DISPLAY DEVICE

FIELD OF INVENTION

The present application relates to the field of display technologies, in particular to a backlight module and a display device.

BACKGROUND OF INVENTION

At present, backlight modules using mini light-emitting diodes (mini-LEDs) or micro light-emitting diodes (micro-LEDs) as a backlight source can greatly improve display effect of liquid crystal display panels. Therefore, mini-LEDs and micro-LEDs are important fields for the future development of displays. Conventional LEDs often use a driving circuit to emit light, but when the LEDs emit light for a long time, a threshold voltage of a driving transistor in the driving circuit is prone to forward bias, resulting in an insufficient charging of the LEDs, and brightness will decrease after a long light emission time, which will affect the display effect.

Therefore, the conventional LED backlight modules have a technical problem that brightness of the LEDs decreases after a long light emission time, and needs to be improved.

SUMMARY OF INVENTION

Technical Problem

Embodiments of the present application provide a backlight module and a display device, which are configured to alleviate a technical problem that brightness of the light-emitting diode (LED) lamps in conventional LED backlight modules decreases after a long time of light emission.

Technical Solution

To solve the above problem, the technical solutions provided by the present application are as follows.

The present application provides a backlight module including a backlight source and a driving circuit for driving the backlight source, the backlight source including a plurality of backlight units arranged in an array, wherein each of the backlight units corresponds to a partition of a liquid crystal display panel, and the driving circuit corresponding to at least one of the backlight units includes:

a data signal input module configured to input a data signal to a first node under a control of a scan signal during a display frame phase;

a driving module connected to the data signal input module through the first node and connected to the at least one of the backlight units through a second node, and configured to drive the at least one of the backlight units to emit light under a control of a potential of the first node and a high-level power signal;

a storage module connected to the driving module through the first node and the second node, and configured to store a threshold voltage of the driving module; and a compensation module connected to the driving module through the first node, and configured to pull down the potential of the first node to be less than a potential of the second node during a blank frame phase to make the threshold voltage of the driving module negatively biased.

In the backlight module of the present application, the data signal input module includes a first transistor, a gate of the first transistor is connected to the scan signal, a first electrode of the first transistor is connected to a data line, and a second electrode of the first transistor is connected to the first node.

In the backlight module of the present application, the driving module includes a second transistor, a gate of the second transistor is connected to the first node, a first electrode of the second transistor is connected to the high-level power signal, and a second electrode of the second transistor is connected to the second node.

In the backlight module of the present application, a first end of the at least one of the backlight units is connected to the second node, and a second end of the at least one of the backlight units is connected to a low-level power signal.

In the backlight module of the present application, the storage module includes a storage capacitor, a first plate of the storage capacitor is connected to the first node, and a second plate of the storage capacitor is connected the second node.

In the backlight module of the present application, an end of the compensation module is connected to the first node, and another end of the compensation module is connected to a timing control chip.

In the backlight module of the present application, the compensation module inputs a first compensation voltage to the first node in the blank frame phase, and the first compensation voltage is a negative value.

In the backlight module of the present application, the compensation module is further configured to raise the potential of the first node during the display frame phase.

In the backlight module of the present application, the compensation module inputs a second compensation voltage to the first node in the display frame phase, and the second compensation voltage is a positive value.

In the backlight module of the present application, the driving circuit further includes a detection module, the detection module is connected to the driving module through the second node, and is configured to detect the threshold voltage of the driving module under a control of a control signal during a detection phase, and wherein the data signal input module is further configured to input a compensated second data signal to the first node according to the threshold voltage detected by the detection module during a display phase.

The present application further provides a display device, which includes a liquid crystal display panel and a backlight module, the backlight module including a backlight source and a driving circuit for driving the backlight source, the backlight source including a plurality of backlight units arranged in an array, wherein each of the backlight units corresponds to a partition of a liquid crystal display panel, and the driving circuit corresponding to at least one of the backlight units includes:

a data signal input module configured to input a data signal to a first node under a control of a scan signal during a display frame phase;

a driving module connected to the data signal input module through the first node and connected to the at least one of the backlight units through a second node, and configured to drive the at least one of the backlight units to emit light under a control of a potential of the first node and a high-level power signal;

a storage module connected to the driving module through the first node and the second node, and configured to store a threshold voltage of the driving module; and a compensation module connected to the driving module through the first node, and configured to pull down the potential of the first node to be less than a potential of the second node during a blank frame phase to make the threshold voltage of the driving module negatively biased.

In the display device of the present application, the data signal input module includes a first transistor, a gate of the first transistor is connected to the scan signal, a first electrode of the first transistor is connected to a data line, and a second electrode of the first transistor is connected to the first node.

In the display device of the present application, the driving module includes a second transistor, a gate of the second transistor is connected to the first node, a first electrode of the second transistor is connected to the high-level power signal, and a second electrode of the second transistor is connected to the second node.

In the display device of the present application, a first end of the at least one of the backlight units is connected to the second node, and a second end of the at least one of the backlight units is connected to a low-level power signal.

In the display device of the present application, the storage module includes a storage capacitor, a first plate of the storage capacitor is connected to the first node, and a second plate of the storage capacitor is connected the second node.

In the display device of the present application, an end of the compensation module is connected to the first node, and another end of the compensation module is connected to a timing control chip.

In the display device of the present application, the compensation module inputs a first compensation voltage to the first node in the blank frame phase, and the first compensation voltage is a negative value.

In the display device of the present application, the compensation module is further configured to raise the potential of the first node during the display frame phase.

In the display device of the present application, the compensation module inputs a second compensation voltage to the first node in the display frame phase, and the second compensation voltage is a positive value.

In the display device of the present application, the driving circuit further includes a detection module, the detection module is connected to the driving module through the second node, and is configured to detect the threshold voltage of the driving module under a control of a control signal during a detection phase, and wherein the data signal input module is further configured to input a compensated second data signal to the first node according to the threshold voltage detected by the detection module during a display phase.

Beneficial Effect

Beneficial effects of the present application are as follows. Embodiments of the present application provide a backlight module and a display device. The backlight module includes a backlight source and a driving circuit for driving the backlight source, the backlight source including a plurality of backlight units arranged in an array, wherein each of the backlight units corresponds to a partition of a liquid crystal display panel, and the driving circuit corresponding to at least one of the backlight units includes a data signal input module, a driving module, a storage module, and a compensation module. The data signal input module is configured to input a data signal to a first node under a control of a scan signal during a display frame phase. The driving module is connected to the data signal input module through the first node and is connected to the at least one of the backlight units through a second node, and is configured to drive the at least one of the backlight units to emit light under a control of a potential of the first node and a high-level power signal. The storage module is connected to the driving module through the first node and the second node, and is configured to store a threshold voltage of the driving module. The compensation module is connected to the driving module through the first node, and is configured to pull down the potential of the first node to be less than a potential of the second node during a blank frame phase to make the threshold voltage of the driving module negatively biased. In the present application, by adding the compensation module to the driving circuit corresponding to at least one backlight unit, during the blank frame phase, a difference between the potentials of the first node and the second node is negative, and the threshold voltage of the driving module is negatively biased. Therefore, a forward bias of the threshold voltage of the driving module in the display frame phase can be corrected, and the forward bias of the threshold voltage of the driving module corresponding to the backlight unit is alleviated, therefore the backlight unit is charged normally, and brightness does not decrease when working for a long time.

BRIEF DESCRIPTION OF FIGURES

In order to illustrate the technical solutions of the present disclosure or the related art in a clearer manner, the drawings desired for the present disclosure or the related art will be described hereinafter briefly. Obviously, the following drawings merely relate to some embodiments of the present disclosure, and based on these drawings, a person skilled in the art may obtain the other drawings without any creative effort.

DETAILED DESCRIPTION OF EMBODIMENTS

Figure 1:
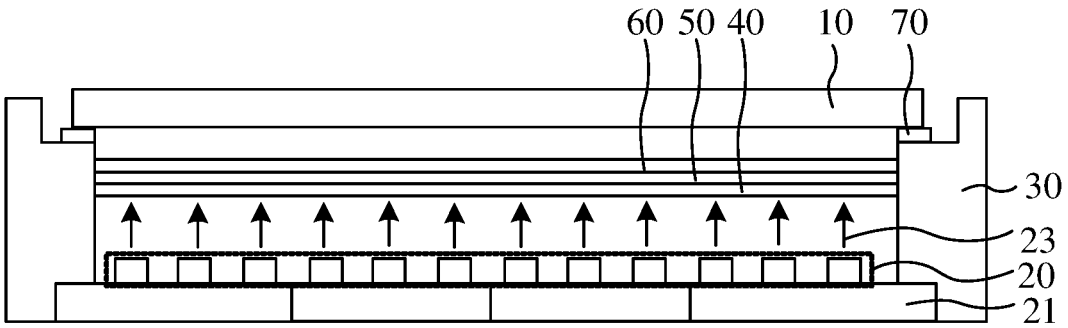
FIG. 1 is a schematic structural diagram of a display device according to an embodiment of the present application.

The following description of each embodiment, with reference to the accompanying drawings, is used to exemplify specific embodiments which may be carried out in the present invention. Directional terms mentioned in the present invention, such as "top", "bottom", "front", "back", "left", "right", "inside", "outside", "side", etc., are only used with reference to the orientation of the accompanying drawings. Therefore, the used directional terms are intended to illustrate, but not to limit, the present invention. In the drawings, components having similar structures are denoted by the same numerals.

An embodiment of the present application provides a display device, and the display device can be a mobile phone, a computer, a tablet, an electronic watch, or the like. As shown in FIG. 1, the display device includes a backlight module and a liquid crystal display panel 10. The liquid crystal display panel 10 is fixed on a plastic frame 30 of the backlight module through an adhesive layer 70. In the backlight module, light 23 emitted by a backlight source 20 provided on a backplate 21 passes through a diffusion plate 40, a reflection sheet 50, and an optical film 60, and then irradiates the liquid crystal display panel 10. The light 23 firstly passes through a lower polarizer of the liquid crystal display panel 10 to become polarized light. The liquid crystal panel 10 inputs different data signal voltages to each pixel through a switching function of thin film transistor (TFT). A rotational state of liquid crystal molecules is different under different voltages, therefore transmittance of the polarized light is also different. Finally, brightness of light emitting through an upper polarizer is also different, thereby achieving multi-grayscale image display.

Figure 2:
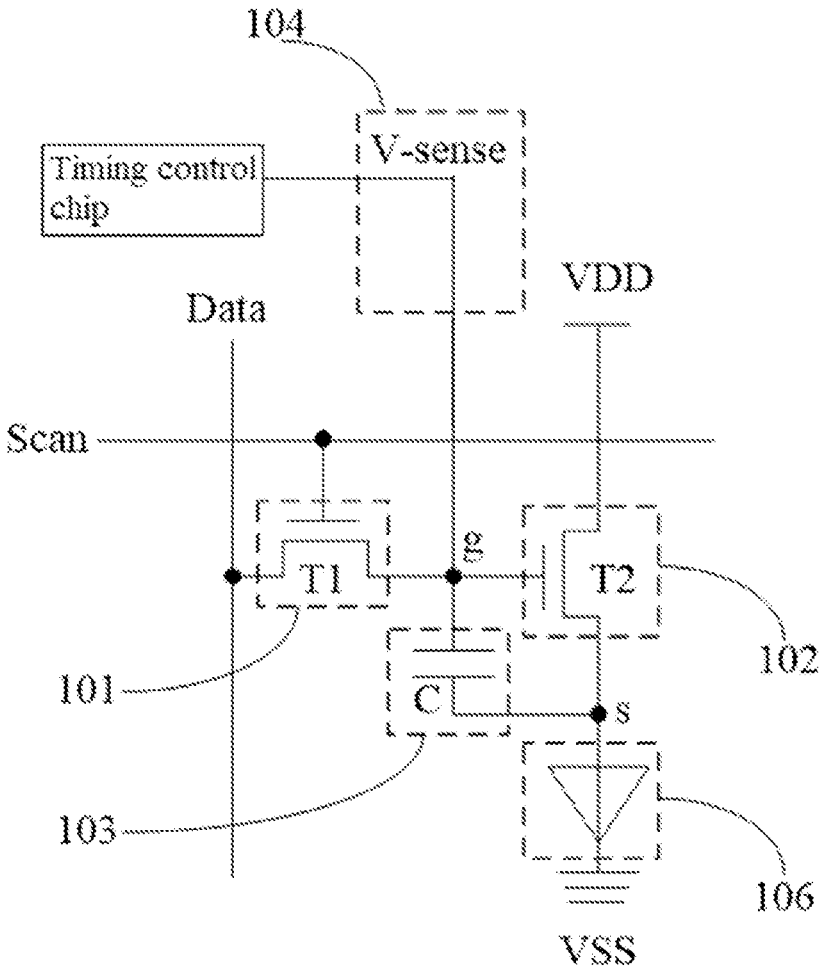
FIG. 2 is a first structural schematic diagram of a driving circuit corresponding to at least one backlight unit in a backlight module according to an embodiment of the present application.

The backlight module includes the backlight source and a driving circuit for driving the backlight source, the backlight source includes a plurality of backlight units arranged in an array, each of the backlight units corresponds to a partition of the liquid crystal display panel, and the driving circuit corresponding to at least one of the backlight units as shown in FIG. 2 includes a data signal input module 101, a driving module 102, a storage module 103, and a compensation module 104.

The data signal input module 101 is configured to input the data signal Data to a first node g under control of a scan signal Scan during a display frame phase.

The driving module 102 is connected to the data signal input module 101 through the first node g, and connected to the backlight unit 106 through a second node s, and is configured to drive the backlight unit 106 to emit light under control of a potential of the first node g and a high-level power signal VDD.

The storage module 103 is connected to the driving module 102 through the first node g and the second node s, and is configured to store a threshold voltage of the driving module 102.

The compensation module 104 is connected to the driving module 102 through the first node g, and is configured to pull down the potential of the first node g to be less than a potential of the high-level power signal VDD during a blank frame phase to make the threshold voltage of the driving module 102 negatively biased.

Specifically, the data signal input module 101 includes a first transistor T1, a gate of the first transistor T1 is connected to the scan signal Scan, a first electrode of the first transistor T1 is connected to the data line Data, and a second electrode of the first transistor T1 is connected to the first node g.

The driving module 102 includes a second transistor T2, a gate of the second transistor T2 is connected to the first node g, a first electrode of the second transistor T2 is connected to the high-level power signal VDD, and a second electrode of the second transistor T2 is connected to the second node s.

A first end of the backlight unit 106 is connected to the second node s, and a second end of the backlight unit 106 is connected to a low-level power signal VSS.

The storage module 103 includes a storage capacitor C, a first plate of the storage capacitor C is connected to the first node g, and a second plate of the storage capacitor C is connected to the second node s.

An end of the compensation module 104 is connected to the first node g, and another end of the compensation module 104 is connected to a timing control chip.

In an embodiment, the compensation module 104 includes a compensation line V-sense. An end of the compensation line V-sense is connected to the first node g, and another end is connected to the timing control chip. During the blank frame phase, the timing control chip pulls down the potential of the first point g to be less than the potential of the high-level power signal VDD, therefore the threshold voltage of the driving module 102 is negatively biased.

In an embodiment, the compensation module 104 includes a transistor, a first electrode of the transistor is connected to the first node g, a second electrode of the transistor is connected to the timing control chip, and a gate of the transistor is connected to a control signal. During the blank frame phase, The control signal inputs a high-level signal to the gate of the transistor, turns on the transistor, and then pulls down the potential of the first point g to be less than the potential of the high-level power signal VDD through the timing control chip. In addition, the structure of the compensation module 104 is not limited to thereto, and can also be other structures formed by connecting several transistors to each other, all of which can input a low-level signal to the first node g during the blank frame phase to pull down the potential of the first node g lower, falls into the protection scope of the present application.

In the present application, one of the first electrode and the second electrode of each transistor is a source, and the other is a drain. An outputting voltage value of the high-level power signal VDD is greater than an outputting voltage value of the low-level power signal VSS. In the driving module 102, the second transistor T2 is a driving transistor, and the threshold voltage of the driving module 102 is a threshold voltage Vth of the second transistor T2.

Figure 3:
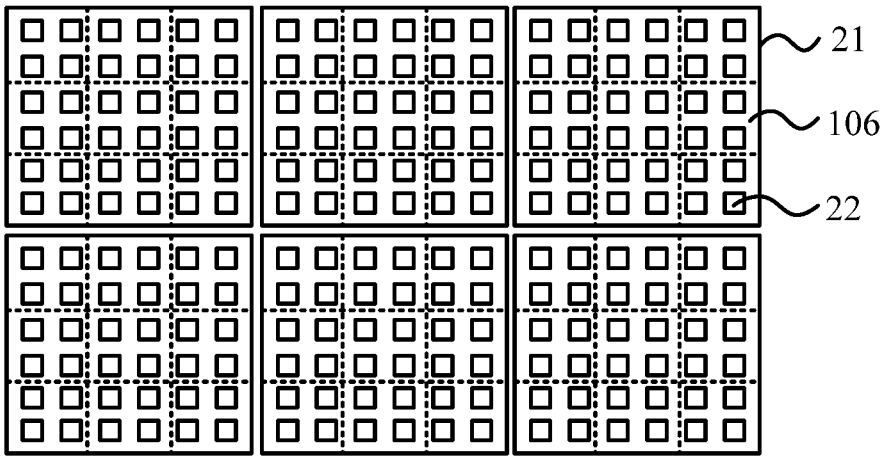
FIG. 3 is a schematic structural diagram of a backlight module according to an embodiment of the present application.

As shown in FIG. 3, the backlight module is formed by splicing a plurality of backplanes 21, each backplane 21 is provided with a plurality of light-emitting diode (LED) devices 22, and all the LED devices 22 in the backlight module form a backlight source. In each backplane 21, the backlight source further includes a plurality of backlight units 106, and the backlight units 106 are distributed in an array. Each backlight unit 106 includes a plurality of LED devices 22 connected in series, which are subsequently tied to the liquid crystal display panel to form the display device. Each backlight unit 106 on the backlight module corresponds to a partition of the liquid crystal display (LCD) panel, wherein each LED device 22 in each backlight unit 106 is driven by a driving circuit to emit light. The backlight module of the present application is used in 8K products with a resolution of 7680×4320. A partition of the LCD panel usually includes a plurality of pixels. The backlight module is formed by splicing 12 backplanes 21, each of the backplanes 21 includes 432 backlight units 106. Each backlight unit 106 includes four LED devices 22 connected in series. The driving circuit drives each backlight unit 106 individually, controls light emission individually, and provides backlight for the pixels in each partition separately. Compared with the backlight module driven by an entire surface, the brightness control of the partition-driven backlight module in the present application is more flexible and the light-emitting effect is better.

Figure 4:
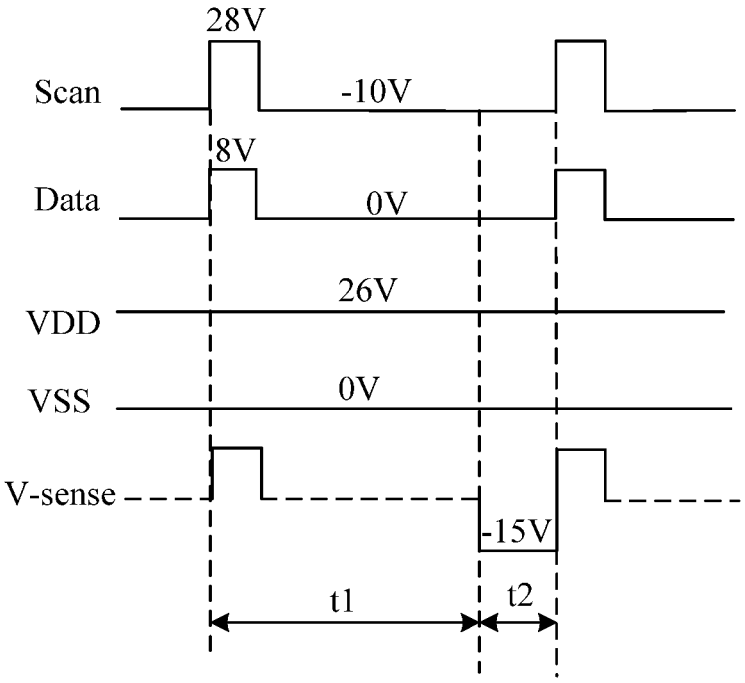
FIG. 4 is a sequence diagram of signals in one frame of the driving circuit shown in FIG. 2.

As shown in FIG. 4, a sequence diagram of signals in one frame of the driving circuit shown in FIG. 2, one frame includes a display frame phase t1 and a blank frame phase t2, where the display frame phase t1 includes a data writing phase and a light-emitting phase.

In the data writing phase, the scan signal Scan is at a high-level and the value is 28V, the first transistor T1 is turned on, the data line Data inputs a high-level data signal to the first node g and the storage capacitor C, the value is 8V, the potential Vg of the first node g is equal to a voltage Vdata, the second transistor T2 is turned on, the high-level power signal VDD inputs a high-level power signal to the second node s and the value is 26V, the low-level power signal VSS is always low and the value is 0V, at the end of this phase, the second transistor T2 operates in a saturated state to drive the backlight unit 106 to emit light.

In the light-emission phase, the scan signal Scan is at a high-level and the value is −10V, the data signal on the data line Data is at a low-level and the value is 0V, the first transistor T1 is turned off, the voltage Vdata on the data line Data cannot reach a gate voltage of the second transistor T2, however, due to storage function of the storage capacitor C, the gate voltage of the second transistor T2 can continue to maintain a data signal voltage Vdata, therefore the second transistor T2 works in a saturated state, a driving current enters the backlight unit 106 through the second transistor T2, thereby driving the backlight unit 106 to continue to emit light.

It can be seen from the above process that in the display frame phase t1, the gate voltage of the second transistor T2 is maintained at a positive voltage state of 8V for a long time, and in this state, the threshold voltage of the second transistor T2 will be in a forward biasing state, a shift amount of threshold voltage forward bias is ΔVth1, and ΔVth1 is a positive value. Meanwhile, a voltage value applied to the gate of the second transistor T2 must also increase in order to fully turn on the second transistor T2. However, if the voltage Vdata on the data line Data is still 8V, the second transistor T2 will be undercharged, which ultimately reduces the brightness of the LED devices in the backlight unit 106 and affects the display effect.

In order to solve aforementioned problem, the conventional art also attempts to replace the second transistor T2 with a metal oxide semiconductor (MOS) transistor for driving, which can prevent a problem of forward bias of the threshold voltage, but cost of using the MOS transistor is higher, and an overall size of the driving circuit after replacement is too large. It also cannot meet the technical requirements of mini-LEDs or micro-LEDs.

In the embodiment of the present application, in the blank frame phase t2, the voltage Vs at the second node s is equal to the high-level power signal, Vs=VDD, meanwhile, the compensation module 103 pulls down the potential of the first node g to be less than the potential of the second node s, that is, less than the potential of the low-level power signal VDD, at this time, Vg is less than Vs, Vg−Vs<0, the threshold voltage of the second transistor T2 will negatively biased, an amount of change in the threshold voltage negatively biased is ΔVth2, where ΔVth2 is a negative value.

Within a frame, the threshold voltage of the second transistor T2 shifts forwardly during the display frame phase t1. By setting the compensation module 103, the potential difference between the first node g and the second node s is negative during the blank frame phase t2. The threshold voltage of the second transistor T2 is negatively biased, showing that an overall threshold voltage change of the frame phase t1 and the blank frame phase t2 is ΔVth1+ΔVth2, because ΔVth1 is a positive value, and ΔVth2 is a negative value, the two cancel each other. Therefore, the threshold voltage Vth of the second transistor T2 returns to a normal state or close to the normal state at the beginning of the next frame, thus alleviating the forward bias of the threshold voltage of the driving module 102, therefore the LED devices in the backlight unit 106 are charged normally. The brightness will not decrease when working for a long time.

In order to make the threshold voltage Vth of the second transistor T2 recover to the normal state as much as possible after an negative biasing correction, after the value of ΔVth1 is detected, a voltage value in the compensation module 104 can be adjusted to make a decreased value of ΔVth2 as close to or equal to an increased value of ΔVth1, where the two cancel each other out to get as close to zero as possible. Since the display frame phase t1 is usually longer, and the blank frame phase t2 is relatively short, in order to make the threshold voltage shift amount ΔVth2 of the second transistor T2 reach an expected value in a shorter time, the blank frame phase t2, a first compensation voltage is input to the first node g through the compensation module 104. The first compensation voltage is a negative value, and is much lower than the value of the low-level power signal VDD. In an embodiment, as shown in FIG. 3, the first compensation voltage value is −15V.

Furthermore, the compensation module 103 is also configured to raise the potential of the first node g during the display frame phase t1. After the backlight unit 106 is operated for a long time, the threshold voltage of the second transistor T2 will shift forward, and a gate voltage required to turn on the second transistor T2 will also be increased. Meanwhile, in the display frame phase t1, a second compensation voltage can be input to the first node g through the compensation module 104, and the second compensation voltage is a positive value. The second compensation voltage is superimposed on the voltage Vdata on the data line Data, which can make the second transistor T2 turn on more fully. The brightness of the backlight unit 106 is improved and restored to a normal level, thereby ensuring the display effect. The value of the second compensation voltage can be calculated according to the detection result after detecting a current value flowing through the backlight unit 106. Wherein, the input second compensation voltage is inversely proportional to a magnitude of a detection current, and the smaller the detection current, the larger the second compensation voltage value.

In the present application, a compensation module 103 is added to an original two transistors and one capacitor (2T1C) driving circuit. During the blank frame phase t2, the difference between the potentials of the first node g and the second node s is negative, and the threshold voltage of the driving module 102 is negatively biased, which can correct the forward bias of the threshold voltage of the driving module 102 in the display frame phase t1, alleviating the forward bias of the threshold voltage of the driving module 102 corresponding to the backlight unit 106. Therefore, each LED device in the backlight unit 106 can be charge normally, and the brightness will not decrease when working for a long time. In the display frame phase t1, the potential at the first node g is raised, therefore the driving module 102 is turned on more fully, and the brightness of the backlight unit 106 is improved. The driving circuit of the present application does not need to replace the type of the driving transistor, the structure is simple, the volume is small, the cost of the mini-LEDs are reduced, and technical reserves can be made for subsequent driving of smaller micro-LED devices.

In addition, in the conventional LED backlight module, due to manufacturing process or aging, a threshold voltage of the driving transistor in the driving circuit is prone to shift, leading to the threshold voltage of the driving transistor being different in the driving circuits of different LED devices inside the panel. Even if the voltage applied to the driving transistor is the same, an actual driving current flowing through the LED devices will eventually be different, resulting in a difference in brightness of the LED devices and uneven brightness of an entire backlight module.

Figure 5:
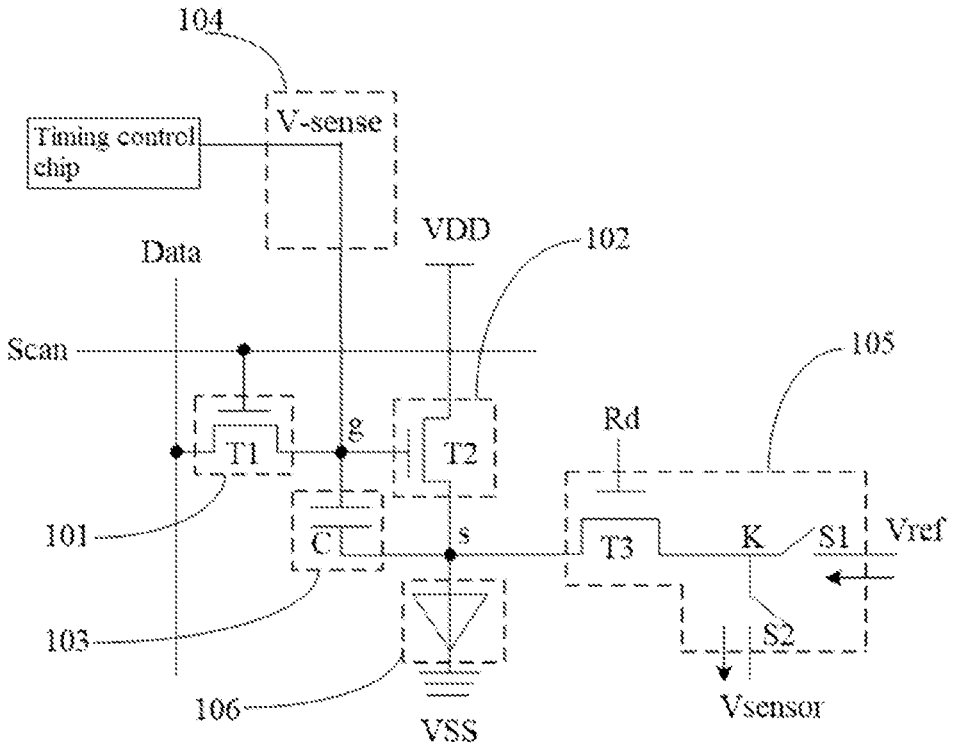
FIG. 5 is a second structural schematic diagram of the driving circuit corresponding to at least one backlight unit in the backlight module according to an embodiment of the present application.

In order to solve the aforementioned problem, as shown in FIG. 5: a second structural schematic diagram of the driving circuit corresponding to at least one backlight unit in the backlight module according to an embodiment of the present application, the difference from the structure in FIG. 2 is that, in the present embodiment, the driving circuit further includes a detection module 105. The detection module 105 is connected to the driving module 102 through the second node s, and is configured to detect the threshold voltage Vth of the driving module 102 under control of a control signal Rd during a detection phase, and wherein the data signal input module 101 is further configured to input a compensated second data signal data2 to the first node g according to the threshold voltage Vth detected by the detection module 105 during a display phase.

Specifically, the detection module 105 includes a third transistor T3 and a selection switch. A gate of the third transistor T3 is connected to the control signal Rd, a first electrode of the third transistor T3 is connected to the second node s, and a second electrode of the third transistor T3 is connected to a moving contact K of the selection switch. A first static contact S1 of the selection switch is connected to a reference voltage input terminal Vref, and a second static contact S2 of the selection switch is connected to a threshold voltage detection terminal Vsensor.

Figure 6:
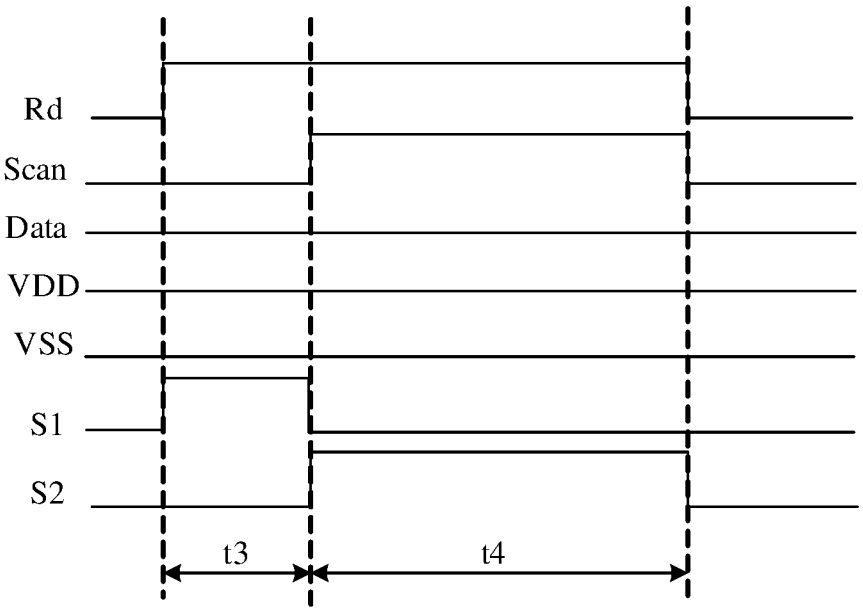
FIG. 6 is a sequence diagram of signals in one frame of the driving circuit shown in FIG. 5.

As shown in FIG. 6, it is a sequence diagram of the driving circuit in FIG. 5 during the detection phase. The detection phase is usually in a time period before the display panel is turned on or a time period after a shutdown. The detection phase includes an initialization time period t3 and a voltage detection time period t4.

During the initialization period t3, the scan signal Scan is at a low-level, the first transistor T1 is turned off, the control signal Rd is at a high-level, the third transistor T3 is turned on, and the moving contact K of the selection switch is connected to the first static contact S1 and inputs a reference voltage Vref to the second node s. Meanwhile, a gate voltage of the second transistor T2 is Vg, the value of Vg can be 0, or it can be a voltage value of an initial voltage signal input to the first point g by the data input module 101 under the control of the scan signal Scan before the detection phase. A voltage of the second electrode of the second transistor T2 is equal to the reference voltage, Vs=Vref, and Vg−Vs>Vth, to ensure that the second transistor T2 works in a linear region after the data voltage is loaded.

During the voltage detection period t4, the scan signal Scan is at a high-level, the first transistor T1 is turned on, and the first data signal data1 having high-level is input to the first node g, the potential of the first node g is equal to the potential of the first data signal data1, Vg=Vdata1. The control signal Rd is maintained at a high-level, the third transistor T3 is turned on, and the moving contact K of the selection switch is connected to the second static contact S2. Meanwhile, the voltage at the second node s continues to rise until Vs=Vdata1−Vth, and the second transistor T2 is turned off. Meanwhile, the potential at the second node s is stable, the threshold voltage detection terminal Vsensor detects the voltage at the second node s, and generates corresponding data and latches it. A detected voltage value at the threshold voltage detection terminal Vsensor is equal to Vdata1−Vth.

Meanwhile, since Vdata1 is a value known in advance, the threshold voltage Vth can be obtained by subtracting the detected voltage from the known Vdata1, Vdata1−Vth.

The sequence diagram of the driving circuit in FIG. 5 during the display phase is same as that in FIG. 4, and the working principles of the transistors are similar, which will not be repeated here. After detecting the threshold voltage of the driving module 102, the detection module 105 reports the detection result to the timing control chip TCON IC. After the detection phase is completed, the TCON IC calculates a compensation value used to compensate the threshold voltage according to the obtained threshold voltage Vth, and determines the second data signal data2 according to the compensation value. By adjusting the voltage values on the scan line Scan and the data line Data to control the input of the second data signal data2 during the display phase, the threshold voltage compensation of the driving transistor is achieved.

The driving circuit of the present application detects the threshold voltage of the second transistor T2 during the detection phase, and then adjusts the voltage value of the second data signal input from the data line Data during the display phase. When the threshold voltage of the second transistor T2 is forwardly biased, the voltage value of the second data signal is adjusted to be greater than a preset value, and when the threshold voltage of the second transistor T2 is negatively biased, the voltage value of the second data signal is adjusted to be less than the preset value, wherein the preset value is a value of the second transistor T2 while the threshold voltage Vth does not shift, and the voltage value input from the data line Data can make the current in the LED device meet the expected voltage value. Through above steps, the second data signal data2 input to the driving circuits of different backlight units 106 is also different. Therefore, the threshold voltage shift of the driving module in the driving circuit corresponding to the backlight unit 106 can be compensated to reduce the difference in driving current flowing through different backlight units 106, thereby improving the uniformity of light emission of the backlight units. When the detection circuits are provided in the driving circuits corresponding to all backlight units, uniformity of light emission of the entire backlight module can be improved, and optical performance of the product can be improved.

Adapting the driving circuit shown in FIG. 5, by setting the detection module 105, the threshold voltage is detected in the detection phase before power-on or after power-off, and then the threshold voltage compensation is performed in the display phase. Therefore, the threshold voltage shift of the driving module in the driving circuit corresponding to the backlight unit 106 can be compensated to reduce the difference in driving current flowing through different backlight units 106, thereby improving the uniformity of light emission of the backlight units. When the detection circuits are provided in the driving circuits corresponding to all backlight units, uniformity of light emission of the entire backlight module can be improved, and optical performance of the product can be improved. Furthermore, by setting the compensation module 104, in the blank frame phase during the display phase, the difference between the potentials of the first node a and the second node b is negative, and the threshold voltage of the driving module 102 is negatively biased, which can correct the forward bias of the threshold voltage of the driving module in the display frame phase, alleviating the forward bias of the threshold voltage of the driving module 102 corresponding to the backlight unit 106. Therefore, each LED device in the backlight unit 106 can be charged normally, and the brightness will not decrease after working for a long time. These two are configured together to improve the threshold voltage shift and improve the display effect.

The present application further provides a display device including a liquid crystal display panel and a backlight module, wherein the backlight module is any one of the backlight modules described above. It can be seen with reference to FIGS. 1 to 4 that the backlight module includes a backlight source and a driving circuit for driving the backlight source, the backlight source includes a plurality of backlight units arranged in an array, each of the backlight units corresponds to a partition of the liquid crystal display panel, and the driving circuit corresponds to at least one of the backlight units includes a data signal input module 101, a driving module 102, a storage module 103, and a compensation module 104. The data signal input module 101 is configured to input the data signal Data to a first node g under control of a scan signal Scan during a display frame phase. The driving module 102 is connected to the data signal input module 101 through the first node g, and connected to the backlight unit 106 through a second node s, and is configured to drive the backlight unit 106 to emit light under control of a potential of the first node g and a high-level power signal VDD. The storage module 103 is connected to the driving module 102 through the first node g and the second node s, and is configured to store a threshold voltage of the driving module 102. The compensation module 104 is connected to the driving module 102 through the first node g, and is configured to pull down the potential of the first node g to be less than a potential of the high-level power signal VDD during a blank frame phase to make the threshold voltage of the driving module 102 negatively biased.

Specifically, the data signal input module 101 includes a first transistor T1, a gate of the first transistor T1 is connected to the scan signal Scan, a first electrode of the first transistor T1 is connected to the data line Data, and a second electrode of the first transistor T1 is connected to the first node g.

The driving module 102 includes a second transistor T2, a gate of the second transistor T2 is connected to the first node g, a first electrode of the second transistor T2 is connected to the high-level power signal VDD, and a second electrode of the second transistor T2 is connected to the second node s.

A first end of the backlight unit 106 is connected to the second node s, and a second end of the backlight unit 106 is connected to a low-level power signal VSS.

The storage module 103 includes a storage capacitor C, a first plate of the storage capacitor C is connected to the first node g, and a second plate of the storage capacitor C is connected to the second node s.

An end of the compensation module 104 is connected to the first node g, and another end of the compensation module 104 is connected to a timing control chip.

In the present application, one of the first electrode and the second electrode of each transistor is a source, and the other is a drain. An outputting voltage value of the high-level power signal VDD is greater than an output voltage value of the low-level power signal VSS. In the driving module 102, the second transistor T2 is a driving transistor, and the threshold voltage of the driving module 102 is a threshold voltage Vth of the second transistor T2.

In an embodiment, during the blank frame phase t2, the compensation module 104 inputs a first compensation voltage to the first node g, and the first compensation voltage is a negative value.

In an embodiment, the compensation module 103 is further configured to raise the potential of the first node g during the display frame phase t1.

In an embodiment, during the display frame phase t1, the compensation module 104 inputs a second compensation voltage to the first node g, and the second compensation voltage is a positive value.

In the display device provided by the present application, by adding a compensation module to the driving circuit corresponding to at least one backlight unit, during the blank frame phase, the potential difference between the first node and the second node is negative, and the threshold voltage of the driving module is negatively biased, which can correct the forward bias of the threshold voltage of the driving module in the display frame phase, alleviating the forward bias of the threshold voltage of the driving module corresponding to the backlight unit. Therefore, each LED device in the backlight unit can be charge normally, and the brightness will not decrease when working for a long time. In the display device of the present application, the LCD panel is an 8K display panel with a resolution of 7680×4320. The LED device in the backlight module can be a conventional LED device, a mini-LED device, or a micro-LED device. Each backlight unit on the backlight module corresponds to a partition of the LCD panel. The driving circuit drives each backlight unit individually, and controls light emission individually. Compared with the backlight module driven by an entire surface, the brightness control of the partition-driven backlight module in the present application is more flexible and light-emitting effect is better.

It can be known as follows according to the above embodiments.

Embodiments of the present application provide a backlight module and a display device. The backlight module includes a backlight source and a driving circuit for driving the backlight source, the backlight source including a plurality of backlight units arranged in an array, wherein each of the backlight units corresponds to a partition of a liquid crystal display panel, and the driving circuit corresponding to at least one of the backlight units includes a data signal input module, a driving module, a storage module, and a compensation module. The data signal input module is configured to input a data signal to a first node under control of a scan signal during a display frame phase. The driving module is connected to the data signal input module through the first node and is connected to at least one of the backlight units through a second node, and is configured to drive at least one of the backlight units to emit light under control of a potential of the first node and a high-level power signal. The storage module is connected to the driving module through the first node and the second node, and is configured to store a threshold voltage of the driving module. The compensation module is connected to the driving module through the first node, and is configured to pull down the potential of the first node to be less than a potential of the second node during a blank frame phase to make the threshold voltage of the driving module negatively biased. In the present application, by adding the compensation module to the driving circuit corresponding to at least one backlight unit, during the blank frame phase, a difference between the potentials of the first node and the second node is negative, and the threshold voltage of the driving module is negatively biased. Therefore, a forward bias of the threshold voltage of the driving module in the display frame phase can be corrected, and the forward bias of the threshold voltage of the driving module corresponding to the backlight unit is alleviated, therefore the backlight unit is charged normally, and brightness does not decrease when working for a long time.

In the above embodiments, the description of each embodiment has its own emphasis. For a part that is not detailed in an embodiment, it can refer to the related descriptions of other embodiments.

The backlight module and the display device according to the embodiments of the present application have been described in detail above. The present document uses specific embodiments to explain principles and implementation of the application. Descriptions of above embodiments are only used to help understand technical solutions and core ideas of the application. A person skilled in the art can make various modifications and changes to the above embodiments without departing from the technical idea of the present invention, and such variations and modifications are intended to be within the scope of the invention.

What is claimed is:

1. A backlight module, comprising a backlight source and a driving circuit for driving the backlight source, the backlight source comprising a plurality of backlight units arranged in an array, wherein each of the backlight units corresponds to a partition of a liquid crystal display panel, and the driving circuit corresponding to at least one of the backlight units comprises:

a data signal input module configured to input a data signal to a first node under control of a scan signal during a display frame phase;

a driving module connected to the data signal input module through the first node and connected to the at least one of the backlight units through a second node, configured to drive the at least one of the backlight units to emit light under control of a potential of the first node and a high-level power signal;

a storage module connected to the driving module through the first node and the second node, and configured to store a threshold voltage of the driving module; and a compensation module connected to the driving module through the first node, and configured to pull down the potential of the first node to be less than a potential of the second node during a blank frame phase to make the threshold voltage of the driving module negatively biased;

wherein the data signal input module comprises a first transistor, a gate of the first transistor is connected to the scan signal, a first electrode of the first transistor is connected to a data line, and a second electrode of the first transistor is connected to the first node;

the driving module comprises a second transistor, a gate of the second transistor is connected to the first node, a first electrode of the second transistor is connected to the high-level power signal, and a second electrode of the second transistor is connected to the second node;

the storage module comprises a storage capacitor, a first plate of the storage capacitor is connected to the first node, and a second plate of the storage capacitor is connected to the second node; and the compensation module comprises a compensation line V-sense, an end of the compensation line V-sense is connected to the first node, and another end of the compensation line V-sense is connected to a timing control chip;

wherein the compensation module inputs a first compensation voltage to the first node in the blank frame phase, and the first compensation voltage is a negative value.

2. The backlight module according to claim 1, wherein a first end of the at least one of the backlight units is connected to the second node, and a second end of the at least one of the backlight units is connected to a low-level power signal.

3. The backlight module according to claim 1, wherein the compensation module is further configured to raise the potential of the first node during the display frame phase.

4. The backlight module according to claim 3, wherein the compensation module inputs a second compensation voltage to the first node in the display frame phase, and the second compensation voltage is a positive value.

5. The backlight module according to claim 1, wherein the driving circuit further comprises a detection module, the detection module is connected to the driving module through the second node, and is configured to detect the threshold voltage of the driving module under control of a control signal during a detection phase, and wherein the data signal input module is further configured to input a compensated second data signal to the first node according to the threshold voltage detected by the detection module during a display phase.

6. A display device, comprising a liquid crystal display panel and a backlight module, the backlight module comprising a backlight source and a driving circuit for driving the backlight source, the backlight source comprising a plurality of backlight units arranged in an array, wherein each of the backlight units corresponds to a partition of a liquid crystal display panel, and the driving circuit corresponding to at least one of the backlight units comprises:

a data signal input module configured to input a data signal to a first node under control of a scan signal during a display frame phase;

a driving module connected to the data signal input module through the first node and connected to the at least one of the backlight units through a second node, configured to drive the at least one of the backlight units to emit light under control of a potential of the first node and a high-level power signal;

a storage module connected to the driving module through the first node and the second node, and configured to store a threshold voltage of the driving module; and a compensation module connected to the driving module through the first node, and configured to pull down the potential of the first node to be less than a potential of the second node during a blank frame phase to make the threshold voltage of the driving module negatively biased;

wherein the data signal input module comprises a first transistor, a gate of the first transistor is connected to the scan signal, a first electrode of the first transistor is connected to a data line, and a second electrode of the first transistor is connected to the first node;

the driving module comprises a second transistor, a gate of the second transistor is connected to the first node, a first electrode of the second transistor is connected to the high-level power signal, and a second electrode of the second transistor is connected to the second node;

the storage module comprises a storage capacitor, a first plate of the storage capacitor is connected to the first node, and a second plate of the storage capacitor is connected to the second node; and the compensation module comprises a compensation line V-sense, an end of the compensation line V-sense is connected to the first node, and another end of the compensation line V-sense is connected to a timing control chip;

wherein the compensation module inputs a first compensation voltage to the first node in the blank frame phase, and the first compensation voltage is a negative value.

7. The display device according to claim 6, wherein a first end of the at least one of the backlight units is connected to the second node, and a second end of the at least one of the backlight units is connected to a low-level power signal.

8. The display device according to claim 6, wherein the compensation module is further configured to raise the potential of the first node during the display frame phase.

9. The display device according to claim 8, wherein the compensation module inputs a second compensation voltage to the first node in the display frame phase, and the second compensation voltage is a positive value.

10. The display device according to claim 6, wherein the driving circuit further comprises a detection module, the detection module is connected to the driving module through the second node, and is configured to detect the threshold voltage of the driving module under control of a control signal during a detection phase, and wherein the data signal input module is further configured to input a compensated second data signal to the first node according to the threshold voltage detected by the detection module during a display phase.

* * * * *